US005330078A

United States Patent [19]

Ficken et al.

[11] Patent Number: 5,330,078

[45] Date of Patent: Jul. 19, 1994

[54] ADDITIVE OVERFLOW REDUCTION SYSTEM FOR AN AUTOMATIC VENDING MACHINE

[75] Inventors: Leonard A. Ficken, Manchester; Franklin D. Newkirk, Florissant, both of Mo.

[73] Assignee: Unidynamics Corporation, Stamford, Conn.

[21] Appl. No.: 41,825

[22] Filed: Apr. 1, 1993

[51] Int. Cl.[5] ..... B67D 5/56

[52] U.S. Cl. ..... 222/129.4; 222/413

[58] Field of Search ..... 222/129.1–129.4, 222/145, 333, 411, 413, 135, 144.5, 185

[56] References Cited

U.S. PATENT DOCUMENTS

| | | | |
|---|---|---|---|
| 3,385,569 | 5/1968 | Bookout | 222/129.4 |
| 3,671,020 | 6/1972 | Krup | 222/129.4 |
| 4,172,669 | 10/1979 | Edelbach | 222/129.4 |
| 4,194,651 | 3/1980 | Martin et al. | 222/129.4 |
| 4,366,920 | 1/1983 | Greenfield, Jr. et al. | 222/413 |
| 4,718,579 | 1/1988 | Brody et al. | 222/129.4 |
| 5,192,002 | 3/1993 | Reese et al. | 222/129.4 |

*Primary Examiner*—Andres Kashnikow
*Assistant Examiner*—Philippe Derakshani
*Attorney, Agent, or Firm*—Senniger, Powers, Leavitt & Roedel

[57] ABSTRACT

An additive overflow reduction system for an automatic vending machine of the hot beverage type which has storage containers for additives such as dry creamer arid sugar and which feeds the additives to a mixing bowl by use of an auger-type feed mechanism. The system includes a reduced area outlet and a minimized volume of product retained adjacent the outlet to allow as little volume of product as practicable to remain in the area of the opening after material has been feed from the opening. A portion of the last flight of the auger is disposed perpendicular to the axis of rotation of the auger to reduce the force on the retained product that would otherwise tend to force the product out of the opening if the machine is vibrated or bumped.

4 Claims, 3 Drawing Sheets

ADDITIVE OVERFLOW REDUCTION SYSTEM FOR AN AUTOMATIC VENDING MACHINE

The present invention relates to product feed systems for automatic vending machines and, more particularly, to a system for preventing the unintended dispensing of a product into a cup that would cause contamination of the intended mixture with an undesired product.

Automatic vending machines for vending liquid into a cup, such as coffee machines, are provided with mechanisms for adding condiment products, such as powdered creamer and sugar, to the desired mixture of flavored coffee. These systems generally include individual containers for the additive products which are provided with feeding mechanisms for metering and feeding the right amount of product to a mixing bowl or chamber where it is mixed with coffee which has just been brewed. The mixture is then fed to a cup where it can then be accessed by a customer.

Many product additive feeding mechanisms include an auger-type feed device which transports the product from a storage container to just above the mixing bowl where it is then dumped into the bowl. Unfortunately, the openings from the auger to the mixing bowl are designed such that even when product from a particular container is not intended to be dumped into the mixing bowl, slight vibrations of the vending machine due, for example, to operation of a coffee grinder or other mechanism, can cause a small amount of product to fall out of the opening of the auger and mix with other ingredients, or just the coffee, and cause an identifiable arid undesirable contaminating taste.

Attempts to eliminate this undesirable contamination have basically been by placing a grating or screening in the opening of the auger to inhibit the falling of product out of the opening into the mixing bowl. This has met with limited success. Since most such additive products are fine powders, such as powdered creamer or sugar, they merely fall through the cracks when time machine is jiggled and continue to contaminate the desired mixture. One of the reasons believed to contribute to this lack of success of such devices to eliminate falling of contaminate amounts from the opening of the auger is the relatively large volume of material which is maintained just behind the mouth of the opening. This large volume tends to fall in a single mass or large chunks when vibrated or jiggled and its inertia forces some of the contaminate additive through the grating or screening.

The present invention overcomes the above described difficulties and disadvantages associated with prior art devices by providing an additive overflow reduction system which reduces the volume of potential contaminate additive left at the end of the auger opening, reduces the size and configuration of the opening in such a way as to reduce spillage without inhibiting normal flow of product during normal operation of the auger and reduces the forward sweep of the auger which otherwise causes forces which tend to force the product from the mouth of the auger. The above advantages are attained by the provision of a product additive system for a product storage container with an auger-type feeding mechanism which transports product from the container, and a mixing bowl into which the product is discharged by the feeding mechanism, the system comprising a housing in which the auger is mounted for rotation and which defines a bore of substantially the same diameter as the auger, the housing forming an opening of substantially half the cross-sectional area of the auger at the end of the auger above the mixing bowl, the auger having a conical end with a base diameter at least half the auger diameter portion protruding through the opening in the housing so as to reduce the cross-sectional area of the opening and prevent residual additive from being disposed in the area of the conical end portion when the auger is not rotating, and the terminal end portion of the auger adjacent the housing opening having at least a last quarter turn disposed perpendicular to the axis of the rotation of the auger to reduce the forces which push the loose material out of the opening. In addition, it is preferred that the auger is a wire form and the conical end portion is formed on a cylindrical plug secured to the auger concentrically within the terminal end portion of the auger and protruding therefrom. In addition, it is preferred that the opening in the housing is a generally semi-cylindrical opening with a horizontal base extending on the diameter of the bore in the housing, a lower portion of the housing adjacent the opening forming a wall within the bore of the housing which is slanted rearwardly from the horizontal base of the opening so as to direct the material upward and outward through the opening adjacent the conical end portion of the auger.

DETAILED DESCRIPTION OF THE PREFERRED EMBODIMENT

Figure 1:
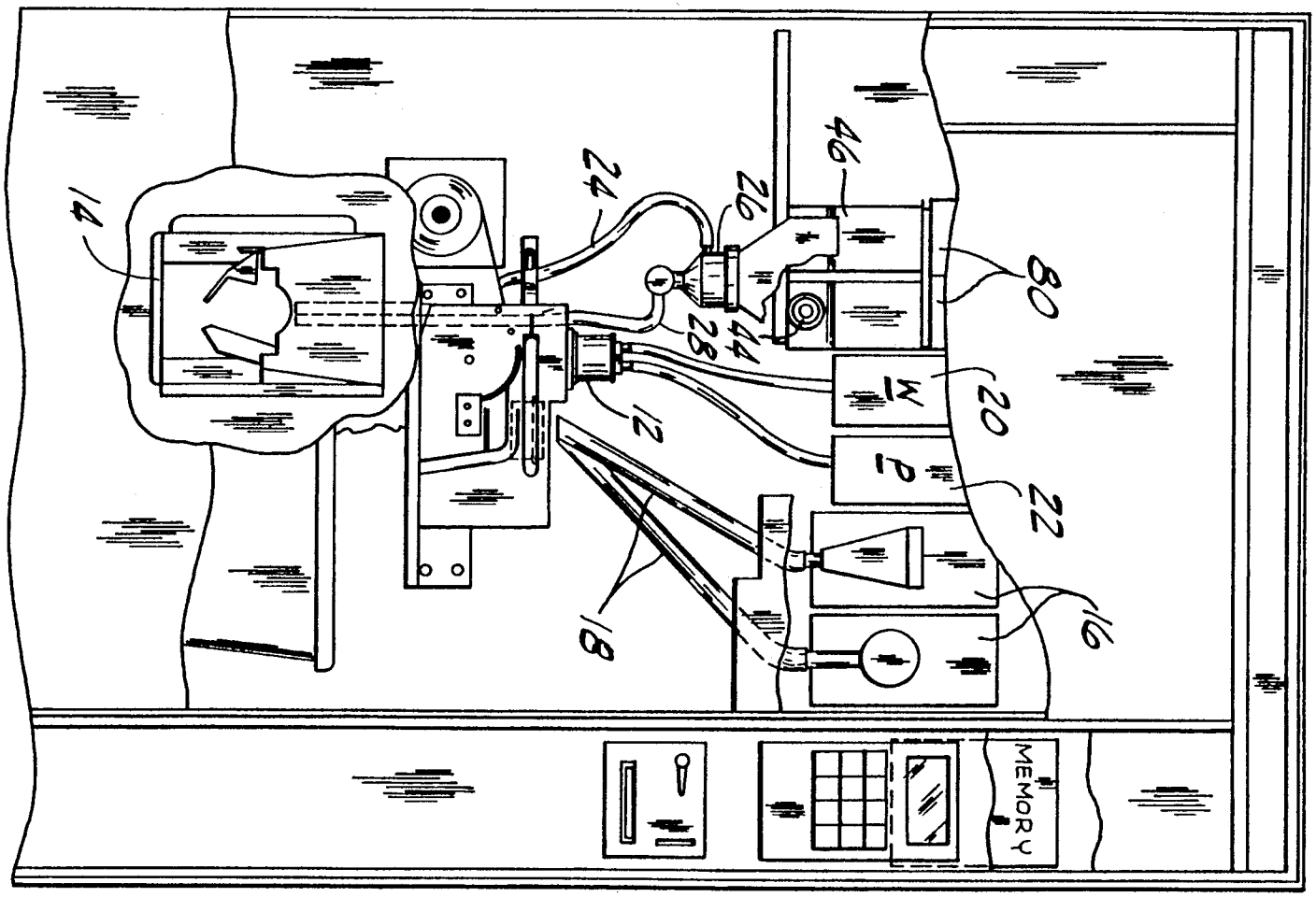
FIG. 1 is a front view of a vending machine partially cutaway to show internal components thereof.

A vending machine 10, as shown in FIG. 1, of the general type which utilizes the feeding mechanism of the present invention is illustrated. This type of vending machine 10 is commonly referred to as a hot drink machine which brews coffee in the brewing chamber 12 and supplies it to the cup station 14 where it is deposited in a cup to be taken by a customer. Ground coffee, either regular or decaffeinated, is contained in at least one canister 16 and supplied to the brewing chamber 12 in a well known manner through the tubes 18. Water is supplied to the brewing chamber 12 from a hot water supply 20 and after the brewing is completed, air pressure from a pressure source 22 ejects the brewed coffee through a tube 24 into a mixing bowl 26 where the brewed coffee is mixed with a condiment or additive product, such as dry creamer, sugar or sugar substitute. The mixed liquid is then supplied through the tube 28 to the cup station 14. The additives are stored in one or more containers 30 which are provided in their lower portion with an auger-type feed mechanism, shown generally as 32.

Figure 2:
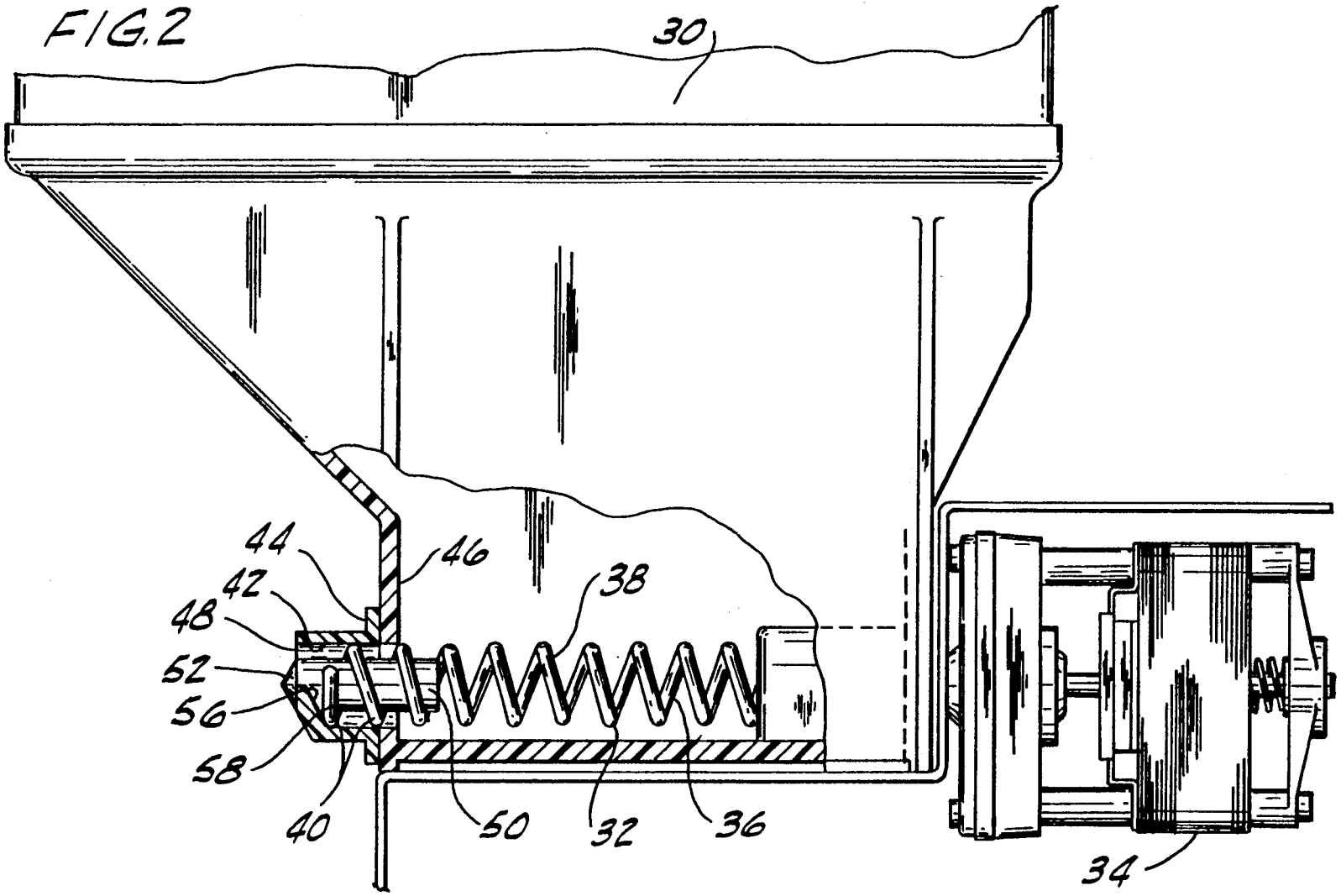
FIG. 2 is an enlarged side view partially broken away of a container incorporating the preferred embodiment of the present invention.

The auger-type feed mechanism 30 generally includes a drive motor 34 which is removably connected to an auger 36 for rotating the auger. The motor 34 is intermittently controlled by a microprocessor for appropriate time of operation in order to feed a predetermined metered amount of additive product. The preferred form of auger 36 is a wire form auger as shown in FIG. 2. The dimensions of auger 36 and the wire 38 from which it is formed are easily determined by one skilled in the art based upon the required output from the auger and other known perimeters which are not directly relevant to the present invention and will therefore not be described in detail. The last few flights 40 of the auger at its outer most terminal end portion extend into a bore 42 defined in a portion 44 of the housing, which as illustrated, is shown as a cap secured to the main body 46 of the housing, although it could be formed integral with the housing 46, if desired.

Figure 3:
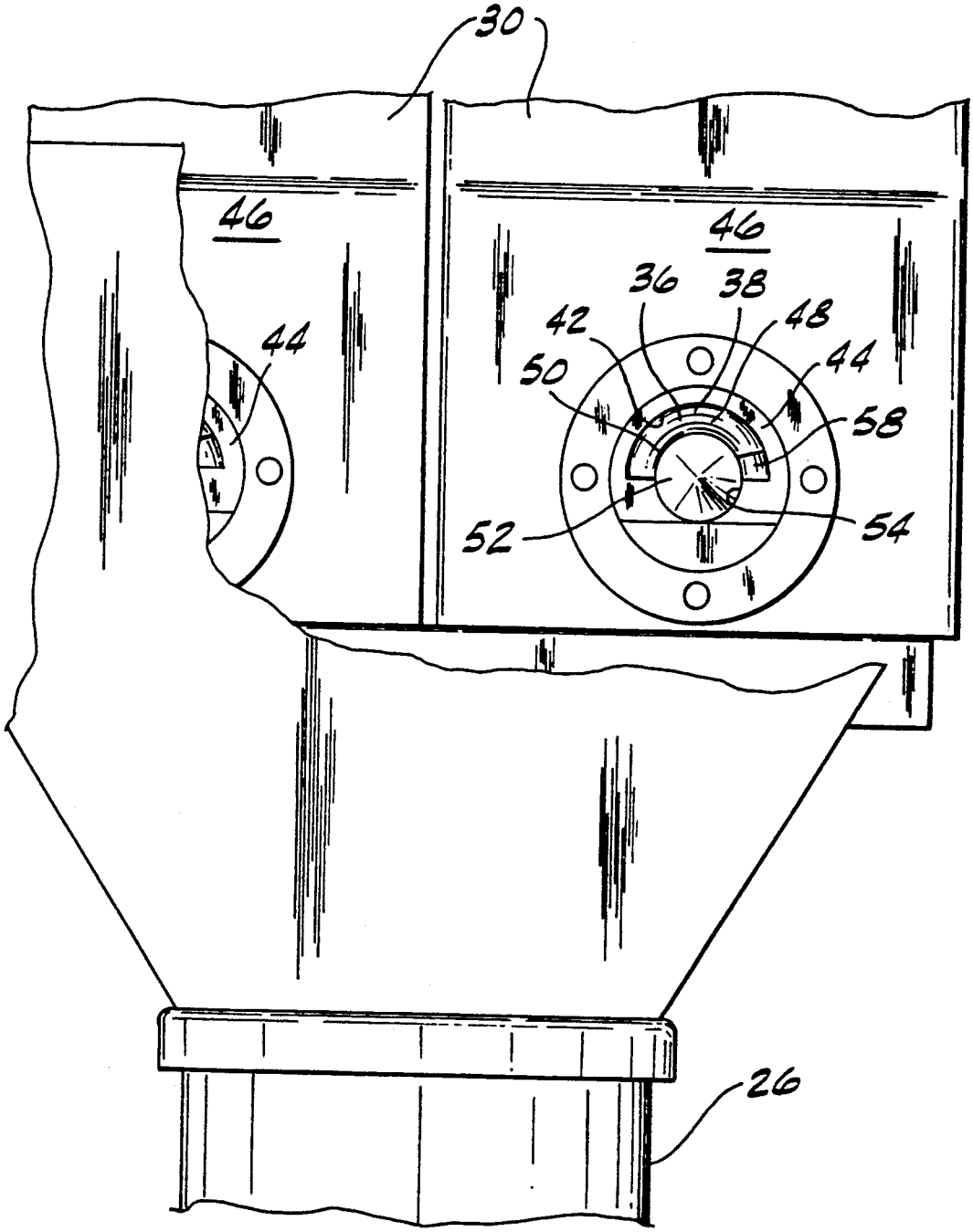
FIG. 3 is a front view looking from the left-hand side of FIG. 2 of the lower portion of the container showing the auger and opening in the housing.

The bore 42 terminates at the outer end of the cap 44 in an opening 48, as best seen in FIG. 3. A cylindrical plug 50 is frictionally fitted into the end of auger 36. The plug 50 in combination with the wires in the last few flights 40 cause the additive product in the container to be fed through the bore 42, which is of substantially the same diameter as the outer diameter of the auger 36, in a well known manner towards the opening 48. The outer terminal end portion 52 of plug 50 is conical and protrudes through a semi-cylindrical mating hole 54, defined in the outer end of the cap 44. This construction results in only a narrow semi-cylindrical band or annulus remaining as an opening 48 through which the additive or product can be expelled by the auger.

The lower internal surface 56 of the cap 44 which abuts the sides of the plug 50 is slanted up towards the opening 48 to cause the product to be fed through the opening by the flights 40 of the auger.

As best seen in FIG. 2, the last flight 58 of the auger is provided with at least a quarter of a turn directed perpendicular to the axis of rotation of the auger. This construction reduces the forward pressure on the product immediately adjacent the opening 48 and thus reduces the tendency of product to be pushed out of the opening with only a slight vibrational movement of the auger. In addition, the distance from the next flight back adjacent the terminal end portion of the last flight 58 is closer to the terminal end and thus closer to the opening, which further reduces the retained volume of material within the opening after an operating cycle of the auger, thus further diminishing the available product which could accidentally be spilled from the opening 48 into the mixing bowl 26.

In the known prior art devices, the conical end portion 52 of the plug inserted in the auger was disposed behind a horizontal wall providing a semi-circular opening for expulsion of the product. In addition, the prior art devices had the terminal flight at the same angle as the remaining flights of the wire auger. Thus, a substantial volume of product was available to be pushed out of the opening accidentally. In addition, since there was a forward angle on the terminal flight, any small vibration would tend to force this relatively large volume of product out through the opening to contaminate the intended mixture iu the mixing bowl. The present invention overcomes these disadvantages associated with such prior art devices and significantly reduces the product which might inadvertently fall from the opening 48 to contaminate a mixture in the mixing bowl 26.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An additive overflow reduction system for an automatic vending machine having at least one additive storage container for storing a supply of an additive such as dry creamer, sugar or sugar substitute, a product mixing bowl to which a selected additive is supplied and mixed with a beverage such as coffee or tea, the at least one storage container including an auger-type delivery mechanism for supplying a metered amount of additive to the mixing bowl, the system comprising:

a housing in which the auger is mounted for rotation and defines a bore of substantially the same diameter as the auger, the housing forming an opening of substantially half the cross-sectional area of the auger at an end of the auger above the mixing bowl, the auger having a conical end with a base diameter at least half the auger diameter portion, protruding through the opening in the housing so as to reduce the cross-sectional area of the opening and prevent residual additive from being disposed in the area of the conical end portion when the auger is not rotating, and a terminal end portion of the auger adjacent the housing opening having at least a last quarter turn disposed perpendicular to the axis of rotation of the auger.

2. The overflow reduction system as defined in claim 1 wherein the auger is a wire form and the conical end portion is formed on a cylindrical plug secured to the auger concentrically within the terminal end portion of the auger and protruding therefrom.

3. The overflow reduction system as defined in claim 2 wherein the conical end portion protrudes beyond the plane of the opening in the housing.

4. The overflow device as defined in claim 3 wherein the opening in the housing is a generally semi-cylindrical opening with a horizontal base extending on the diameter of the bore in the housing, a lower portion of the housing adjacent the opening forming a wall within the bore of the housing slanted rearwardly from the horizontal base of the opening.

* * * * *